US007097571B2

(12) United States Patent
Kraus

(10) Patent No.: US 7,097,571 B2
(45) Date of Patent: Aug. 29, 2006

(54) GOLF TRAINING DEVICE

(76) Inventor: Kenneth Kraus, 2009 Yacht Resolute, Newport Beach, CA (US) 92660

( * ) Notice: Subject to any disclaimer, the term of this patent is extended or adjusted under 35 U.S.C. 154(b) by 0 days.

(21) Appl. No.: 11/047,938

(22) Filed: Feb. 1, 2005

(65) Prior Publication Data

US 2006/0172812 A1 Aug. 3, 2006

(51) Int. Cl.
*A63B 69/36* (2006.01)

(52) U.S. Cl. ..... 473/212; 473/214

(58) Field of Classification Search ..... 473/207, 473/212, 213, 214, 63; 482/112, 118
See application file for complete search history.

(56) References Cited

U.S. PATENT DOCUMENTS

| | | | | | |
|---|---|---|---|---|---|
| 1,418,637 | A | * | 6/1922 | Flood | 473/213 |
| 2,312,523 | A | * | 3/1943 | Corbett | 602/21 |
| 2,468,580 | A | | 4/1949 | Weis et al. | |
| 2,809,042 | A | * | 10/1957 | Wasley | 473/214 |
| 3,074,723 | A | | 1/1963 | Esty | |
| 3,423,095 | A | * | 1/1969 | Cox | 473/213 |
| 3,658,345 | A | | 4/1972 | Siggson | |
| 3,900,199 | A | | 8/1975 | McGonagle | |
| 3,975,015 | A | | 8/1976 | Owens et al. | |
| 4,070,027 | A | | 1/1978 | Kifferstein et al. | |
| 4,373,213 | A | | 2/1983 | Erlandson | |
| 4,504,054 | A | | 3/1985 | Jackson et al. | |
| 5,069,457 | A | | 12/1991 | Korzenowski | |
| 5,207,430 | A | * | 5/1993 | Goins | 473/213 |
| 5,279,545 | A | * | 1/1994 | Reese, Sr. | 602/21 |
| 5,425,539 | A | | 6/1995 | Steffes | |
| 5,445,385 | A | | 8/1995 | Brooks | |
| 5,662,594 | A | * | 9/1997 | Rosenblatt | 602/16 |
| 6,293,918 | B1 | * | 9/2001 | Wang | 602/20 |
| 6,692,453 | B1 | * | 2/2004 | Wolfe | 602/21 |
| 6,866,646 | B1 | * | 3/2005 | Hopkins et al. | 602/5 |

* cited by examiner

*Primary Examiner*—Nini F. Legesse
(74) *Attorney, Agent, or Firm*—William G. Lane

(57) ABSTRACT

A golf swing training device that fits on the inner down swing arm and optionally it has a thumb restraint extension. The device comprises a shell contoured to fit the inner arm from the wrist to the lower portion of the upper arm which is strapped to the arm. The device cocks the arm slightly but fully extends the arm for the back swing and down swing and aids the golfer in forming the right habit by muscle memory to extend the arm during the golf swing. The device is flexible laterally so that a snug fit between the device and the arm can be obtained. The device can twist to accommodate the twisting of the arm during the golf swing. The device resists bending of the forearm about the elbow to keep the forearm extended. The thumb extension inhibits flexure and side to side movement of the thumb during the golf swing. The thumb extension can be detachably attached to the shell.

27 Claims, 4 Drawing Sheets

GOLF TRAINING DEVICE

FIELD OF THE INVENTION

The invention relates to a training device for improving the golf swing, more particularly to an arm brace to control position the upper arm with the lower arm during the back swing and the down swing (also called the drive swing or power swing) of a golfer.

DESCRIPTION OF THE PRIOR ART

The golf swing to drive a golf ball either with a wood or an iron appears deceptively simple. It seems like anybody could grab a golf club and hit the golf ball either off the fairway or from a tee and drive it straight and far with ease. Unfortunately, the golf swing is one of the most complicated athletic movements. If done properly, as is frequently done by pros, the golf ball does go far and it goes straight. Most amateur golfers will hook or slice the ball at least once during a round of golf. Even the golf pros slice or hook the ball from time to time. When the ball is not hit straight, it frequently ends up in water, the rough, a sand trap, the adjoining fairway, or out of bounds. For pro golfers, they learn, as they must, to work out of a sand trap or the rough in the most efficient manner. Unfortunately for the amateur golfer, it is a more difficult endeavor to work out of a hazard, adding strokes and frustration to the game. To be a good golfer, the golfer must be consistent. To be a good golfer, distance is not the primary object. The object is to hit the ball where you want it to be.

The golf swing is made up of a number of components including the stance, posture, position of the head, the position and rotation of the shoulders, the rotation of the hips, the swing or movement of the legs during the back swing and down swing, the position of the hands on the grip of the golf club, the positions and movement of the arms during the swing, and the like. Each component involved in the swing plays an important part. Some components, such as posture and the positioning of the hands on the club grip, are easy to master whereas other components are more difficult to master, such as keeping your head down, the movement of the legs during the swing, and the position and movement of the arms during both the back swing and the down swing. For purposes of this patent, the forearm is the arm facing the direction the ball is to be driven and the back arm is the other arm. For the swing of a right handed golfer, the left arm is the forearm. For the swing of a left handed golfer, the right arm is the forearm. The back swing is the initial swing of the club head away from the ball up to and frequently above, and back of, the shoulder (the right shoulder for a right handed golfer and the left shoulder for a left handed golfer). The down swing starts from the back swing and is the swing of the club head against the golf ball. The higher the velocity of the down swing, the farther the ball will go if the club head properly address the ball at impact.

BACKGROUND OF THE INVENTION

Golf is enjoyed by people of all ages throughout the world. It is played and enjoyed by both athletic types and non-athletic types of people. It is one of the few athletic activities that can be played and enjoyed by people with handicaps, such as a missing limb, a bad back, sight problems, and the like.

Seemingly, the golf swing to drive a ball with a wood or hit a ball with an iron should be the most natural and easiest thing in the world. It should be no more difficult than hitting a baseball with a bat or returning a tennis ball with a tennis racket. However, the golf swing is truly one of the most complicated athletic endeavors. Although it is true that anyone can get up, take a club and swing at the ball, the club head may miss the ball, or the ball may not go far, or it may not go straight, or it may not go anywhere. The golf swing requires the proper posture, the proper placement of the legs with respect to the ball, the proper positioning of the hands on the golf club grip, and proper rotation of the shoulders and the hips during the back swing and the downward power swing. Many of the requirements for the proper golf swing can be easily mastered by most individuals, such as posture, positioning of the feet, and the hand the grip on the golf club grip. However, other aspects of the golf swing are not easily mastered. Even great golfers like Bobby Jones, Sammy Snead, Arnold Palmer, Jack Nicholas, and Tiger Woods, can slip from time to time, resulting in poor shots, either in distance and/or direction. Most professional golfers have teachers who observe their swings and to identify their problems and remedy what the problem is with respect to the swing. Frequently the problems with the swing are very small but very significant factors. One of the essential factors in the proper swing is extension of the arms.

For purposes of this patent, the description of the golf swing and the invention will be made with respect to the swing of a right-handed golfer, i.e. a golfer who down swings the club from right to left when facing the ball. The right-handed golfer's forearm is his or her left arm. An arm has four sides: an inner side that faces the trunk, an outer side, a top or ventral side facing the front, and a back or dorsal side facing the back. The directions refer to directions when the arms are at the side of a person with the thumb next to pant-pocket facing forward.

Normally in a golf swing, proper extension of the right arm is not a problem. However, extension of the left arm is frequently a problem. Most golfers, unless they diligently practice, have a tendency not to extend the forearm during the back swing. For these golfers, when they are in the down swing, they fully extend the arm which changes the direction of the face of the club with respect to the ball and causes the ball to hook or slice and inhibits maximum club head velocity which prevents the maximum amount of energy to be transferred from the club head to the ball at impact. Thus both distance the ball goes and the direction the ball goes are affected by not extending the left arm during the back swing. Many golf books and a number of golf teachers always stress to the golfer to straight-arm the left arm on the back swing. This is a reminder to the golfer to extend the arm. Unfortunately, the forearm is not truly straight-armed during the back swing. There is a slight curve or crook at the elbow, but the forearm is extended out to give the greatest amount of energy to the golf swing and to correctly have the face of the golf club hit the ball to drive the ball far and straight. When the golfer attempts to make a full swing with a straight-arm or stiff-arm left arm, it is uncomfortable and the arm which has to rotate during the down swing, does not impart the maximum amount of energy to the ball and frequently alters the direction of the club face. When the face of the club does not properly address the ball at impact, the ball goes in a direction the golfer never intended. For purposes of this patent, to drive the ball means to hit the ball with a wood, an iron, or with a wedge.

Most of the prior art devices are truly elbow stiffener devices that restrain the elbow in a straight-arm condition (see U.S. Pat. Nos. 3,074,723; 3,900,199; 3,658,345; 5,425,539; 4,070,027; 4,504,054; 5,069,547; 2,468,580).

In order train golfers to maintain the left arm extended, with respect to a right-handed golfer, the training device must be comfortable. When the training device is not comfortable, the device will be quickly discarded because it is uncomfortable to use for practice or a round of golf. Although training devices cannot be used in tournament play, they can be used in a regular golf game assuming the other golfers do not object. The prior art training devices described above are either cylinders or sheet-like structures which are wrapped like a cylinder to go around the arm. Some have a foam pad interior to attempt to make the device more comfortable. Training devices that do not fit the anatomical contour of the arm are inherently uncomfortable.

As mentioned above, during the back swing and especially during the down swing, the forearm, the left arm for a right-handed golfer, slightly rotates. This is a natural result of the skeletal and muscular relationship of the arm. The golfer should not attempt to prevent this rotation and should let the down swing be natural as long as the left arm and the right arm are extended. The cylindrical training devices illustrated in the above-identified patent do not twist as the forearm is rotated. The cylindrical device resists torsionally twisting. Thus a cylindrical training device resists the rotation of the forearm during the down swing which effects swing and effects the way the ball is hit off the club. This is not a natural swing, the cylindrical training device inhibits the national rotation of the forearm.

The arm has an upper arm and lower arm. The lower arm is relatively long, and a training devices that only inhibits movement adjacent the elbow does not have sufficient purchase on the upper arm and the lower arm to minimize bending about the forearm elbow to train the golfer to keep the forearm extended during the back swing.

As mentioned above, one of the factors of a successful golf swing is proper placement of the golfer's hands on the golf club grip. In addition to not extending the forearm during the back swing, some golfers have a tendency to move the thumb of the hand of their forearm during the back swing. The golf club is normally gripped when the club is placed in front of the golfer with the head of the club resting on the ground and the shaft pointing up to the lower chest of the golfer. The golfer places the hands on the grip in the appropriate manner. This grip is not held tightly, but is held firmly enough so that when the golfer performs a back swing and the down swing, the grip does not change on the golf club grip. This assures that the head of the club properly addresses the golf ball at impact when the club has been properly swung and drives the ball straight down the fairway in the direction the golfer desires. For the beginning golfer, it is difficult to realize that a slight shift in the grip can have dramatic effects on the direction of the golf ball. Incorrect gripping of the golf club or changing or moving the grip during the back swing and/or the down swing, can easily make the golf ball hook or slice. Besides raising the score, it is generally embarrassing to the golfer when slices or hooks badly. In addition, a bad slice or hook can also be dangerous to other golfers playing in adjacent fairways. Any homeowner along a fairway of a golf course develops a collection of golf balls and often broken windows and cracks in the sides of house from bad slices and hooks. When the golfer does shift the grip during the back swing or down swing, the golfer normally only alters the position of the thumb on the forearm hand. The other fingers are normally "fixed" to the club grip because they are needed to maintain the golf club in the hands of the golfer. If the golfer does have a habit of flexing the thumb of the forearm hand during the swing, the golfer must be trained to keep the thumb in the original position when he or she took up the grip. It is important to prevent flexure of the thumb to maintain the club in a vertical orientation at the top of the back swing. None of the above prior art devices restrain movement of the thumb during the golf swing.

The object of the present invention is to provide a golf swing training device generally contoured to the shape of the inner arm to fit comfortably on the golfer.

It is a further object of the present invention to provide a golf swing training device that keeps the forearm extended. The device is designed to extend the forearm and give the arm a slight angle between the lower arm and the upper arm and about the elbow. The device does not contort the forearm into a straight-arm position.

A further object of the present invention is to provide a golf swing training device that torsionally rotates or twists during the golf swing so that the golfer has a natural feeling to the swing and the forearm is not restrained from rotating during the back swing and down swing.

An even further object of the present invention is to provide a golf swing training device that will maintain the arm in the extended position by providing an arm restraint that will minimize further bending of the forearm about the elbow during the back swing and down swing.

Another object of the present invention is to provide a golf swing training device that permits the forearm to be fully extended at the point of impact of the club face with the ball during the down swing.

Still another object of the present invention is to provide a golf swing training device that can be snugly fit onto the inner forearm of the golfer to train the golfer to keep the forearm extended during the golf swing.

An additional object of the present invention is to provide a thumb restraint that restrains the thumb of the forearm from flexure during the back swing of the golf club to keep the club relatively vertical (front view).

SUMMARY OF THE INVENTION

The present invention is direct to a golf swing training device comprising a longitudinal, laterally curved, shell at least roughly contoured to fit and partially surround the inner arm from the wrist to the lower portion of the upper arm, the shell having a proximal end and an opposite distal end, first and second side extending longitudinally from the proximal end to the distal end, and an outer surface and an inner surface, the shell having an upper arm region, an elbow region, a forearm region, and a wrist region extending from the proximal end to the distal end, respectively; the upper arm region being slightly angled to the forearm region and the wrist region about the inner elbow region to give the arm a slight bend; and one or more bindings to dettachably attach the shell to the inner arm. The binding[s] securing the upper arm region to the inner side to the lower portion of the inner arm, the forearm region to the inner side of the forearm, and the wrist region to the inner side of the wrist. Preferably, the shell is approximately contoured to fit the contour or shape of the inner arm; most preferably the shell is contoured to fit the contour or shape of the inner arm. Preferably, the shell covers the inner arm and most of the ventral and dorsal sides of the forearm from the wrist to the lower portion of the inner arm.

In the preferred embodiment, the bindings comprise a first, second, and third straps, each strap having a first end secured to the shell and a second end detachably secured to the shell. The first end of the first strap secured to the upper arm region near the proximal end of the shell and the second end of the first strap detachably secured to the upper arm region near the proximal end of the shell; the first end of the third strap secured to the wrist region near the distal end of the shell and the second end of the third strap detachably secured to the wrist region near the distal end of the shell; and the first end of the second strap secured to the forearm region near the elbow region of the shell and the second end of the second strap detachably secured to the forearm region adjacent the elbow region of the shell.

In the preferred embodiment of the present invention, the shell is only slightly bendable about the elbow region. That is, the upper arm portion of the shell can only be slightly bent about the elbow region with respect to the forearm region and the wrist region of the shell. In the preferred embodiment, the bindings comprise first, second, and third straps, each strap having a first end secured to the shell and a second end detachably secured to the shell. Preferably the first end and the second end are secured to the outer surface of the shell. Most preferably, the first and second ends of each strap are detachably secured to the shell.

In the preferred embodiment, the first end of the first strap is secured to the upper arm region near the proximal end of the shell and the second end of the first strap to be detachably secured to the upper arm region near the proximal end of the shell; the first end of the third strap is secured to the wrist region near the distal end of the shell of the second end of the third strap is detachably secured to the wrist region near the distal end; and the first end of the second strap is secured to the forearm region near the elbow region of the shell and the second end of the second strap is detachably secured to the forearm region near the elbow region of the shell.

In the preferred embodiment, the shell is squeezable laterally so that the shell can be snugly and comfortably fit to the inner arm employing straps. In the preferred embodiment, the shell is torsionally twistable with respect to the proximal and distal ends. That is, the shell can be twisted between the proximal end and the distal end.

In one embodiment of the invention, the inner surface of the shell has a foam layer as a cushioning layer and/or as a form fitting layer between the inner arm and the shell.

Preferably the first end of at least one of the straps is detachably secured to the shell. Preferably all the first ends of all the straps are detachably secured to the shell. Preferably the first end of all the straps are secured to the outer surface of the shell.

In one embodiment, the first end of each of at least one strap is secured to the shell and the second end of the strap is detachably secured to the strap.

In another embodiment, at least one of the straps is adapted to encircle the arm and the shell to secure at least a portion of the training device to the arm, one end of the strap each strap being detachably secured to the strap.

In another embodiment of the present invention, each strap is adapted to encircle the arm and shell to secure the shell to the arm, one end of each strap being adapted to be detachably secured to the strap.

In still another embodiment of the present invention, the golf swing training device includes a thumb restraint to restrain flexure movement of the thumb during the back swing comprising a longitudinal, laterally curved body having a proximal end and an opposite distal end, and an inner surface and outer surface, an attachment section adjacent the proximal end adapted to mate with the outer surface of the wrist region of the shell and a thumb region longitudinally extending from the attachment section to the body's distal end and adapted to receive the thumb; a binding element to secure the inner surface of the attachment section of the body to the outer surface of the wrist region of the shell; and at least one band to detachably attach the body to the lower portion of the thumb. Preferably the thumb restraint includes a second band to detachably attach the body to the wrist.

Preferably the bands comprise first and second restraint straps, each restraint strap having a first end secured to the body and a second end detachably secured to the body.

In the most preferred embodiment, the first end of the first restraint strap is detachably secured to the attachment section of the body and the second end of the first restraint strap is detachably secured to the attachment section of the body; and the first end of the second restraint strap is detachably secured to the thumb region of the body and the second end of the second restraint strap is detachably secured to the thumb region of the body.

Preferably the first end of at least one of the restraint straps securing the body to the thumb is secured to the outer side of the body. In the most preferred embodiment of the thumb restraint, the second end of at least one restraint strap is also detachably secured to the outer surface of the body.

In the most preferred embodiment of the present invention, the first end of each of the restraint straps is detachably secured to the body.

In another embodiment of the thumb restraint, at least one restraint strap has a first end secured to the body and a second end detachably secured to the restraint strap.

In still another embodiment of the thumb restraint, the restraint straps are adapted to encircle the thumb and wrist and the body to secure the thumb restraint to the thumb with one end of each restraint strap being adapted to be secured to the body and the other end of each restraint strap being adapted to be detachably secured to itself.

In still another embodiment of the present invention, the thumb restraint is an extension of the shell extending out longitudinally from the shell.

DESCRIPTION OF THE INVENTION

Figure 1:
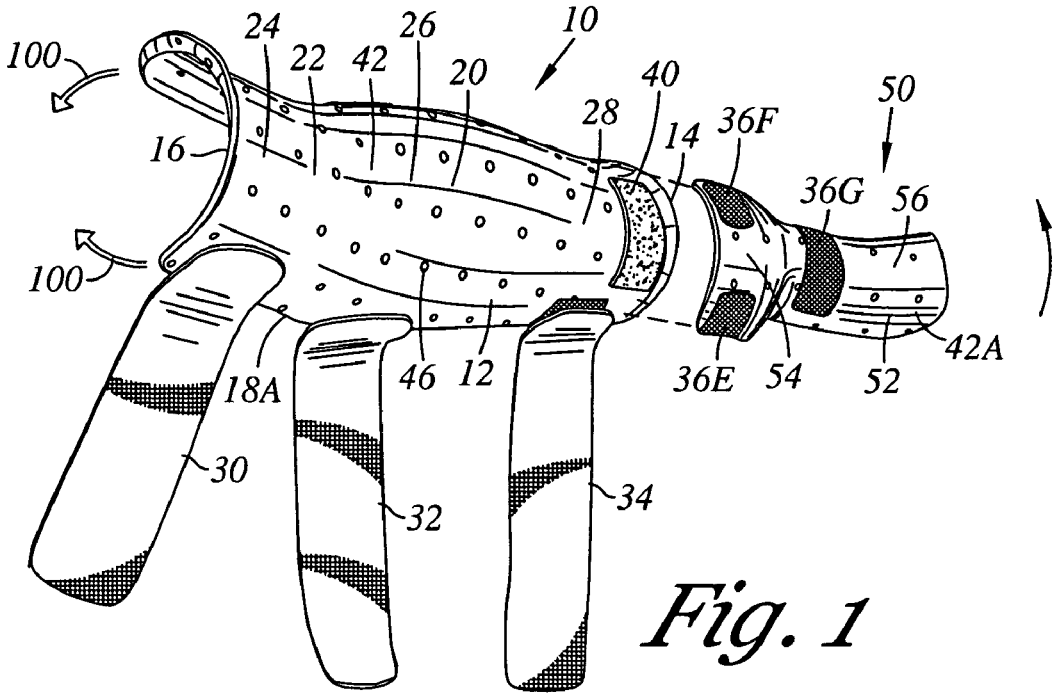
FIG. 1 is a perspective view from proximal end of the golf swing training device of the present invention.
Figure 2:
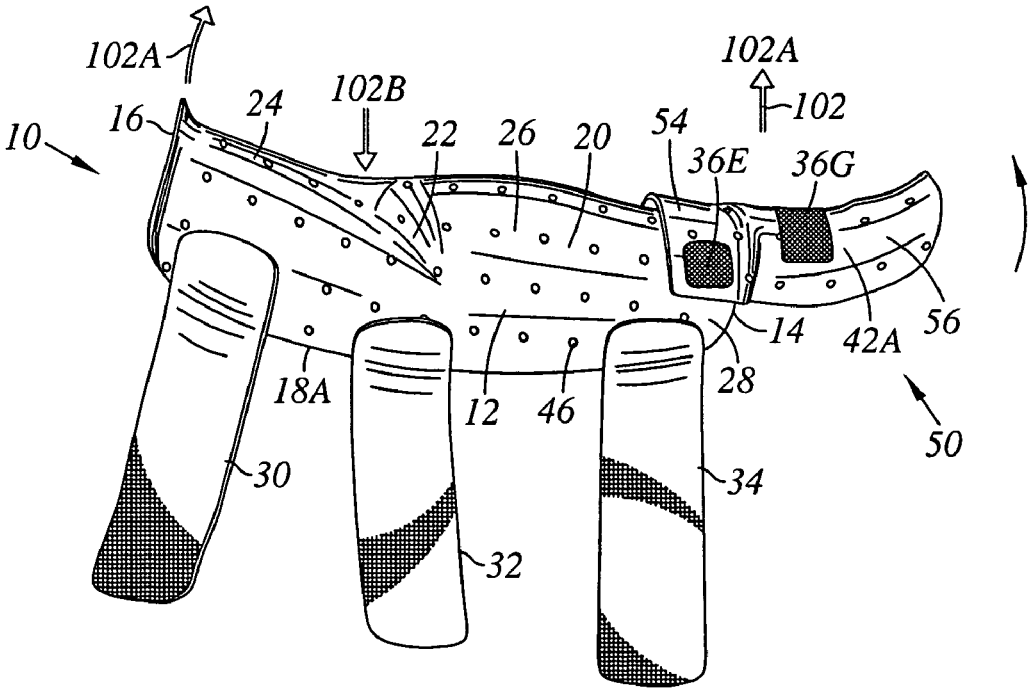
FIG. 2 is a side view of the device of FIG. 1.
Figure 3:
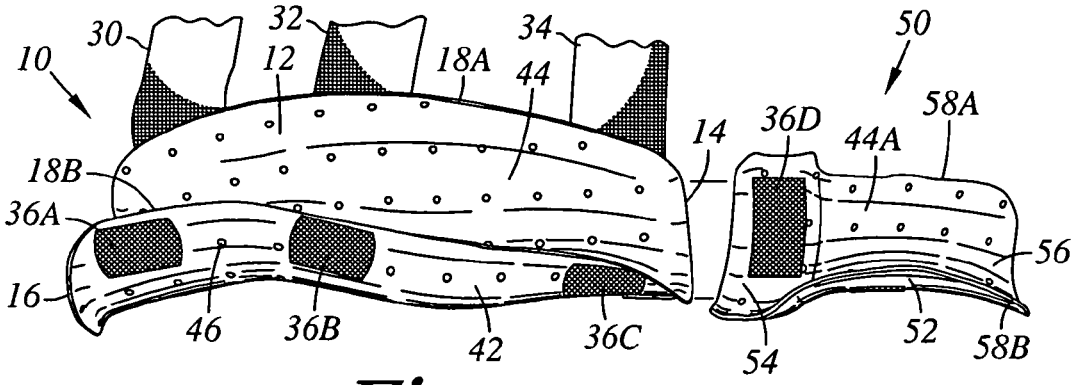
FIG. 3 is a side bottom perspective view of the device of FIG. 1.
Figure 4:
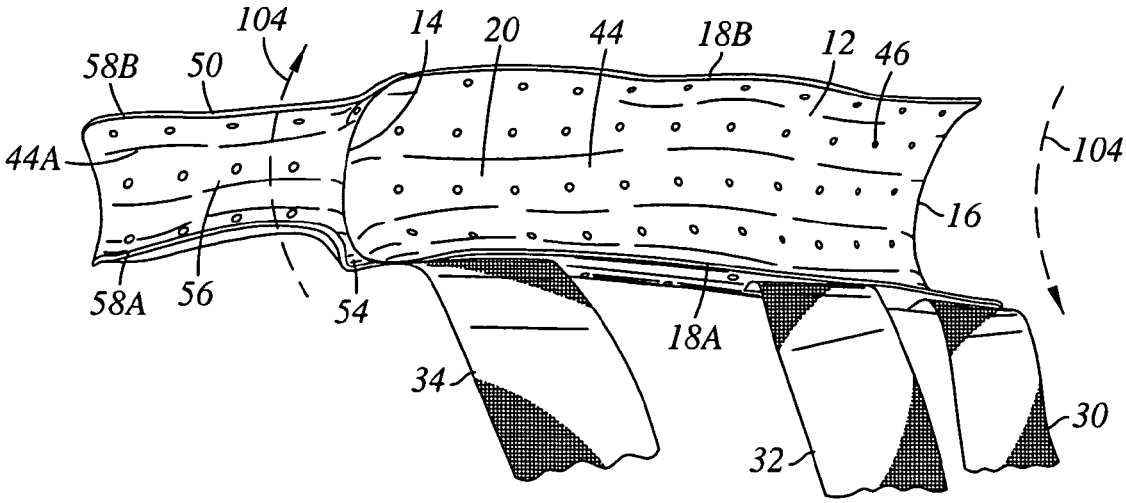
FIG. 4 is a bottom view from the distal end of the golf swing training device of the present invention.
Figure 5:
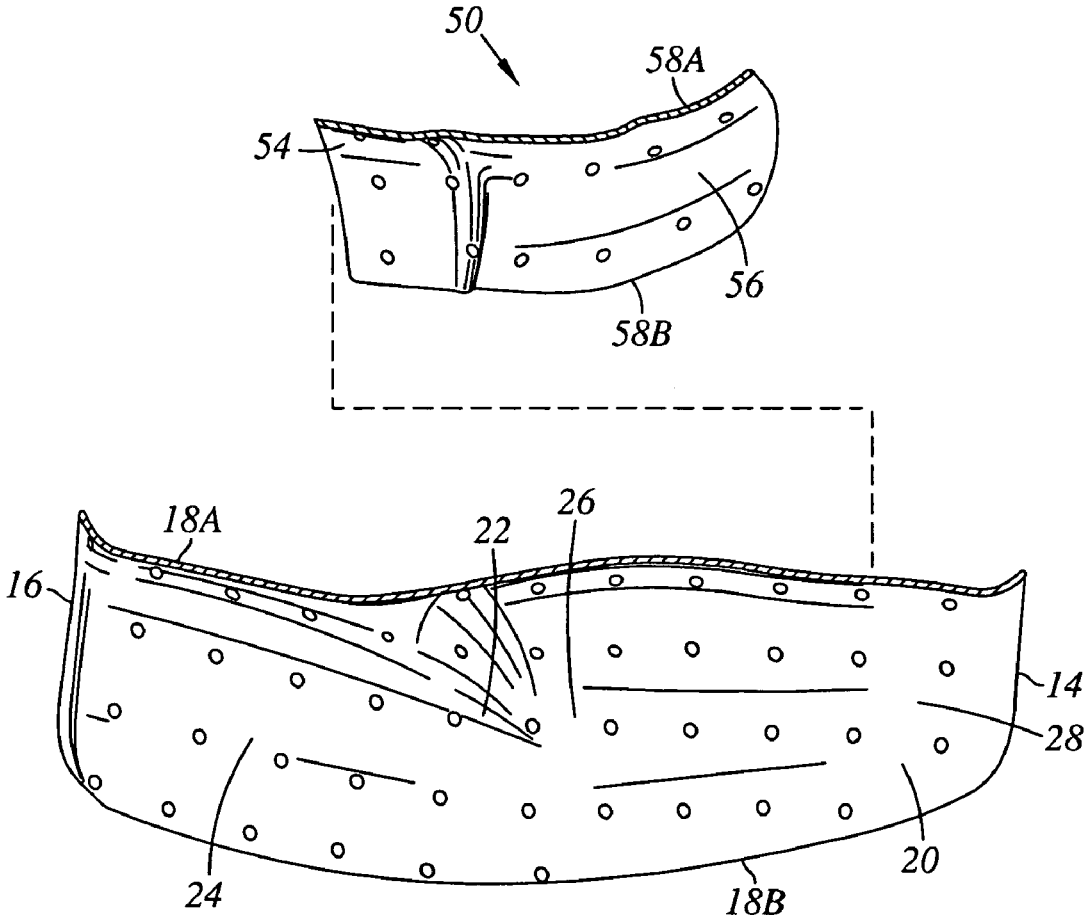
FIG. 5 is a longitudinal cross sectional view of the golf swing training device and the thumb restraint of FIG. 1.

Referring to FIGS. 1–5, the golf swing training device 10 shell 12 with the separate thumb restraint 50 attached are illustrated. The golf swing training device comprises a shell 12 with a plurality of attachment straps 30, 32, and 34. The shell has a proximal end 14 and a distal end 16 and side edges 18A and 18B extending longitudinally along the shell from the proximal end to the distal end. The shell is curved and contoured to fit the inner side of the forearm of the golfer. The right arm and left arm are mirror images. The forearm is the left arm for a right-armed golfer, that is the arm facing the direction the golf ball is to be driven by the golf club. In contrast, the forearm is the right arm for the left-armed golfer. The shell is given a contour so that it fits the inner arm of either the left arm or right arm. The shell can be contoured to fit both arms, but the invention will be described for shells that are contoured for the left arm. Shells contoured for the right arm are mirror images of the shells for the left arm. Although not shown, the shell can have a foam lining normally not more than one-half inch thick to closely conform the contour of the inner arm to the golf swing training device when the shell is secured to the arm as described below.

The shell has four regions extending from the proximal end 14 to the distal end 16: an upper arm region 24; an elbow region 22; a forearm region 26; and a wrist region 28. The shell is curved to cover the inner arm and most of the ventral and dorsal sides of the forearm. The shell has attached to it a proximal end strap 30 which is used to secure the upper arm region of the shell to the upper arm, a distal end strap 34 which is used to secure the wrist region of the shell to the wrist and a forearm strap 32 just below the elbow to the arm which is used to secure the lower arm region of the shell to the lower arm just below the elbow. The straps can be permanently fixed to the shell with one end of each strap secured to the outer surface 40 of the shell 12. However, it is preferred to have the straps detachably attached to the outer surface of the shell. Alternatively, the straps can have at least one end either permanently attached or detachably attached to the inner surface 44 of the shell. Velcro® brand fabric/barbed straps which can be detachably secured to barbed/fabric pads, such as pads 36A, 36B, and 36C permanently attached to the outer surface 42 of the shell, 12 can be used. By using detachably attached straps to attach the training device to the inner arm, the straps can be cut to size and they can be easily detachably attached to secure the shell to the inner arm and can be easily adjusted for fitting the device 10 to the golfer's forearm.

The device is show with a shell having a plurality of small air holes 46. Employment of air holes in the shell in order to enhance air circulation between the shell and the skin of the arm is optional and it is not required for the successful practice of the invention.

If the golfer does not have a problem with movement of the thumb during the swing, the shell alone can be utilized to train extension of the forearm during swings. The device is utilized to give muscle memory to the golfer so that the golfer develops the habit of extending his or her forearm during the back swing. After extension is mastered, the training device will no longer be needed unless bad habits return. If the golfer has a tendency to revert back to older bad habits, the training device can again be utilized to refresh muscle memory.

As mentioned above, some golfers have a tendency to move the thumb of the down swing arm during the back swing. For those golfers, the thumb restraint 50 is secured to the shell. The thumb restraint restricts thumb flexure and thus maintains the golf club in a vertical orientation at the end of the back swing (see FIG. 6). Many professional golfers raise their arms to an extent that the golf club crosses over the back of their shoulders. This is not recommended for non-professionals because of the complexity of the resulting down swing. If the golfer desires to use the pro style swing, the forearm is still extended. In the embodiment of the invention illustrated in the Figures, the shell and thumb restraint can be detachably attached to one another. However, the training device can be constructed so that the thumb restraint and the shall are a single element continuous from the distal end of the thumb restraint to the proximal end of the shell (not shown).

In the embodiment shown, the thumb restraint 50 is detachably secured to the distal end of the shell by employing Velcro® brand connectors. The outer surface 42 of the shell at the distal end has barbed pads or a fabric pad of the Velcro® brand connector attached and the inner surface 44A of the thumb restraint has fabric pads or barbed pads of the Velcro® brand connector, respectively, attached to detachably attach the thumb restraint to the distal end of the shell. If the golfer's thumb movement is relatively slight, a single strap can be used to secure the thumb restraint on the hand just below the thumb employing pads 36E and 36F. The top surface 42A of the body has a Velcro® brand fabric pad or barbed pad secured thereto and the strap is a Velcro® brand barbed strap or fabric strap, respectively, to secure the strap to the thumb restraint. If the golfer has a tendency to flex the thumb during the back swing, then a second strap is recommended. The second strap secures the attachment section 54 of the thumb restraint to the thumb by having a strap extend from the pad 36G on the outer surface 42A of the attachment section around the thumb and back to pad 36G. Again, the Velcro® brand connector and strap have been found very convenient to use, although other detachable attachment systems can be utilized to secure the shell and/or body to the forearm and/or thumb. In the embodiment shown, the outer surface 42A of the attachment section 54 has pads 36E and 36F (a strap is secured to these pads in the manner described above), and pad 36G (a strap is secured to that pad as described above).

Figure 6:
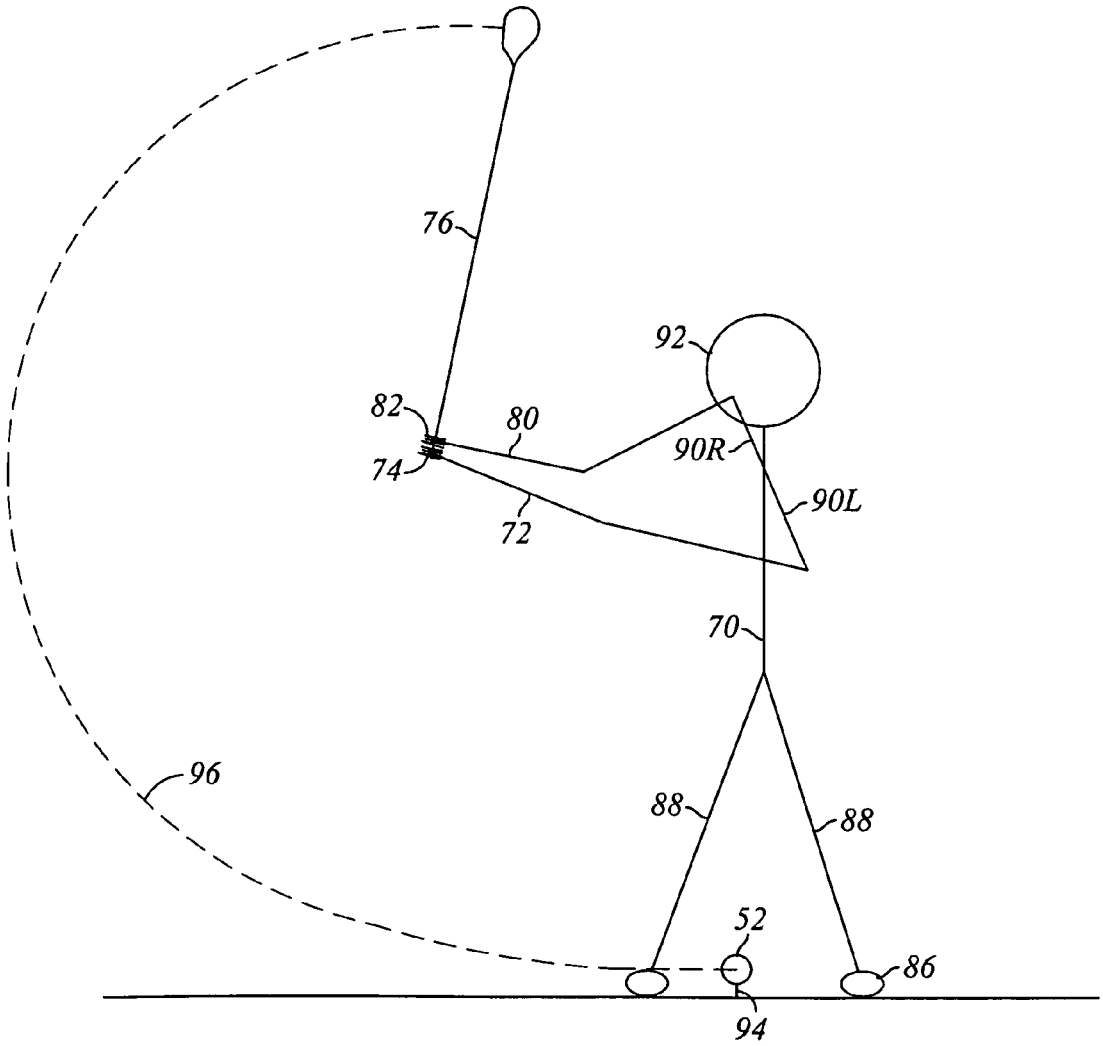
FIG. 6 is a front plan view of a stick figure showing the golf club at the end of the back swing and the arc of the down swing.

Referring to FIG. 6, a stick figure of a golfer is illustrated at the top of the back swing. The golfer has both feet 86 solidly on the ground, the legs 88 are slightly bent (not shown), the golfer 70 is slightly bent over at hips with his or her back straight, the head 92 is pointed down for viewing the ball 52 which is mounted on a tee 94, the left shoulder 90L and the right shoulder 90R are tilted in the direction of the club but not at the angle illustrated in FIG. 6 which is exaggerated. The forearm 72, the left arm for a right handed golfer, is extended outward and slightly bent and the right arm 80 is extended but more bent than the left arm to compensate for the shorter distance between the shoulder 90R and the handle 82 of the golf club 76. For non-professional golfers, this is a suitable posture, and the vertical position of the golf club 76 as viewed from the front side is the proper orientation for a powerful and accurate swing along arc 96 to the ball 52. The thumb restraint prevents flexure of the thumb of the left hand 74 which helps maintain the golf club 76 in a near vertical position viewed from the front. When viewed from the side, the golf club 76 is bent back more from the vertical. Normally the head of the golf club lies just behind the hips of the golfer.

It has been found convenient to make the shell of the body out of plastic material normally about one-eighth inch thick, although other thicknesses may be employed. Because of the curved shape, the body resists bending of the upper arm section with respect to the lower arm region and the wrist region about the elbow region by forces indicated by arrows 102A and 102B in FIG. 2. Although the device can resist bending as just described, the device can be twisted with respect to each end as shown in FIG. 1 by directional arrows 100. Thus, the shell can twist slightly clockwise or counterclockwise between the distal and proximal ends during the swing. The turning of the arm is a natural response to the swing caused by the skeletal/muscular anatomy of the arm. The shell is somewhat flexible in that the side edges 18A and 18B of the shell can be squeezed toward each other, i.e. laterally squeezed, as shown by directional arrow with 100 in FIG. 1. This permits the shell to be snugly, but comfortably, fit against and around the inner arm of the forearm of the golfer when the straps are attached as described above.

As discussed above, when the golfer does the back swing of either a wood or an iron, many teachers stress that the arm should be straight out. That is not the correct posture for the forearm. The golfer should extend the forearm but not make it a straight arm. A straight arm is not only uncomfortably, but it is an improper posture for the forearm. The forearm has a slight angle or crook when extended which is natural and comfortable to the golfer when completing the back swing. The shell 12 of the device 10 of the present invention has the upper arm region setoff between about five and ten degrees with respect to the forearm region and the wrist region about the elbow region. This is the proper crook or angle of the forearm and when utilizing the device of the present invention to practice the golf swing, the device helps the arm to establish the habit of extending the forearm during the back swing by muscle memory of keeping the forearm extended during the back swing. The device also aids in forming a habit for the forearm to remain extended as it commences the down swing. Normally, there is no problem with forearm extension at the bottom of the down swing. But some golfers after completing the back swing and starting the down swing, will have a tendency to crook the forearm and then extend the forearm just prior to the club's contact with the ball. This not only decreases the amount of energy that the club imparts to the ball, but it also effects how the club head addresses the ball.

What is claimed is:

1. A golf training device comprising a longitudinal, laterally curved one piece shell at least roughly contoured to fit and partially surround the inner arm from the wrist to the lower portion of the upper arm, the shell having a proximal end and an opposite distal end, first and second sides extending longitudinally from the proximal end to the distal end, and an outer surface and an inner surface, the shell having an upper arm region, an elbow region, a forearm region, and a wrist region, extending from the proximal end to the distal end, respectively, the upper arm region being angled to the forearm region and the wrist region about the inner elbow region to give the arm a slight bend; and one or more bindings to detachably attach the shell to the inner arm; the binding securing the upper arm region to the inner side of the lower portion of the upper arm, the forearm region to the inner side of the forearm, and the wrist region to the inner side of the wrist.

2. The golf swing training device according to claim 1 wherein the shell is only slightly bendable about the elbow region.

3. The golf swing training device according to claim 1 wherein the bindings comprise first, second, and third straps, each strap having a first end secured to the shell and a second end detachably secured to the shell.

4. The golf swing training device according to claim 3 wherein the first end and the second end are secured to the outer surface of the shell.

5. The golf swing training device according to claim 3 wherein the first end of the first strap is secured to the upper arm region near the proximal end of the shell and the second end of the first strap to be detachably secured to the upper arm region near the proximal end of the shell; the first end of the third strap is secured to the wrist region near the distal end of the shell and the second end of the third strap is detachably secured to the wrist region near the distal end of the shell; and the first end of the second strap is secured to the forearm region near the elbow region of the shell and the second end of the second strap is detachably secured to the forearm region near the elbow region of the shell.

6. The golf swing training device according to claim 3 wherein the upper arm portion of the shell is only slightly bendable about the elbow region with respect to the forearm region and the wrist region of the shell.

7. The golf swing training device according to claim 6 wherein the shell is squeezable laterally so that the shell can be snugly and comfortably fit to the inner arm employing the straps.

8. The golf swing training device according to claim 6 wherein the shell is twistable between the proximal and distal ends.

9. The golf swing training device according to claim 1 wherein the inner surface of the shell has a foam cushioning layer.

10. The golf swing training device according to claim 3 wherein the first end of at least one of the straps is detachably secured to the shell.

11. The golf swing training device according to claim 3 wherein the first ends of the straps are detachably secured to the shell.

12. The golf swing training device according to claim 11 wherein the first end of all the straps are secured to the outer surface of the shell.

13. The golf swing training device according to claim 3 wherein the first end of each of the first, second, and third strap are secured to the shell and the second end of the first, second, and third straps are detachably secured to the first, second, and third straps, respectively.

14. The golf swing training device according to claim 3 wherein the first, second, and third straps are adapted to encircle the arm and the shell to secure the training device to the arm, one end of each strap being detachably secured to the strap.

15. The golf swing training device according to claim 3 wherein each strap is adapted to encircle the arm and shell to secure the shell to the arm, one end of each strap being adapted to be detachably secured to the strap.

16. The golf swing training device according to claim 1 wherein the golf swing training device includes a thumb restraint to restrain flexure and side to side movement of the thumb during the golf swing comprising a longitudinal laterally curved body having a proximal end and an opposite distal end and an inner surface and outer surface, adapted to mate with the outer surface of the wrist region of the shell and a thumb region longitudinally extending from an attachment section proximate the proximal end to the body's distal end and adapted to receive the thumb; a binding element to secure the inner surface of the attachment section of the body to the outer surface of the wrist region of the shell; and a first band to detachably attach the body to the lower portion of the thumb.

17. The golf swing training device according to claim 16 wherein the thumb restraint includes a second band to detachably attach the body to the wrist.

18. The golf swing training device according to claim 16 wherein the first and second bands comprise first and second restraint straps, each restraint strap having a first end secured to the body and a second end detachably secured to the body.

19. The golf swing training device according to claim 18 wherein the first end of the first restraint strap is secured to the attachment section of the body and the second end of the first restraint strap is detachably secured to the attachment section of the body; and the first end of the second restraint strap is secured to the thumb region of the body and the second end of the second restraint strap is detachably secured to the thumb region of the body.

20. The golf swing training device according to claim 18 wherein the first end of at least one of the restraint straps securing the body to the thumb is secured to the outer side of the body.

21. The golf swing training device according to claim 18 wherein the second end of at least one restraint strap is also detachably secured to the outer surface of the body.

22. The golf swing training device according to claim 18 wherein the first end of each of the restraint straps is detachably secured to the body.

23. The golf swing training device according to claim 18 wherein at least one strap has a first end secured to the body and a second end detachably secured to the strap.

24. The golf swing training device according to claim 18 wherein the restraint straps are adapted to encircle the thumb and wrist and the body to secure the thumb restraint to the thumb with one end of each restraint strap being adapted to be detachably secured to the body and the other end of the restraint strap being adapted to be detachably secured to the restraint strap.

25. The golf swing training device according to claim 1 wherein the shell includes a thumb restraint extending from the distal end of the shell, the golf swing training device wherein the golf swing training device includes a thumb restraint to restrain flexure and side to side movement of the thumb during the golf swing comprising a longitudinal laterally curved body having a proximal end and an opposite distal end and an inner surface and outer surface, the inner surface of the body adapted to mate with the outer surface of the wrist region of the shell and a thumb region longitudinally extending from an attachment section proximate the proximal end of the body to the body's distal end and adapted to receive the thumb; a binding element to secure the inner surface of the attachment section of the body to the outer surface of the wrist region of the shell; and at least one band to detachably attach the body to the lower portion of the thumb.

26. The golf swing training device according to claim 1 wherein the shell is contoured to the contour of the inner arm.

27. The golf training device according to claim 1 wherein the bindings comprise a first, second, and third straps, each strap having a first end secured to the shell and a second end detachably secured to the shell; the first end of the first strap secured to the upper arm region near the proximal end of the shell and the second end of the first strap detachably secured to the upper arm region near the proximal end of the shell; the first end of the third strap secured to the wrist region near the distal end of the shell and the second end of the third strap detachably secured to the wrist region near the distal end of the shell; and the first end of the second strap secured to the forearm region near the elbow region of the shell and the second end of the second strap detachably secured to the forearm region adjacent the elbow.

* * * * *